US005971014A

United States Patent [19]

Duren

[11] Patent Number: 5,971,014

[45] Date of Patent: Oct. 26, 1999

[54] VACUUM BREAKER VALVE VENT FITTING CLEAN-OUT DEVICE

[76] Inventor: Gary S. Duren, 6812 Camp Rd., Keystone Heights, Fla. 32656-8013

[21] Appl. No.: 09/086,909

[22] Filed: May 29, 1998

Related U.S. Application Data

[63] Continuation of application No. 08/706,669, Sep. 4, 1996.

[51] Int. Cl.[6] ..... F16K 15/00; F16K 24/00

[52] U.S. Cl. ..... 137/526; 137/584

[58] Field of Search ..... 137/526, 583, 137/584, 360, 361; 4/211

[56] References Cited

U.S. PATENT DOCUMENTS

| | | | |
|---|---|---|---|
| Re. 35,532 | 6/1997 | Duren . | |
| 2,127,184 | 8/1938 | O'Leary | 137/526 |
| 2,461,392 | 2/1949 | Parry . | |
| 3,096,782 | 7/1963 | Williams | 137/360 |
| 3,324,922 | 6/1967 | Hargreaves et al. | 137/360 |
| 3,862,433 | 1/1975 | Rousselet | 137/360 |
| 3,923,081 | 12/1975 | Persson . | |
| 4,158,471 | 6/1979 | Logsdon | 137/360 |
| 4,232,706 | 11/1980 | Ericson . | |
| 4,545,398 | 10/1985 | van Olst . | |
| 4,867,802 | 9/1989 | Earl . | |
| 4,917,147 | 4/1990 | Jerkins | 137/584 |
| 4,934,410 | 6/1990 | Humber | 137/360 |
| 4,974,632 | 12/1990 | Ericson | 137/526 |
| 4,991,623 | 2/1991 | Ericson | 137/526 |
| 5,048,562 | 9/1991 | Frawley . | |
| 5,050,632 | 9/1991 | Means, Jr. | 137/360 |
| 5,273,068 | 12/1993 | Duren | 137/526 |

*Primary Examiner*—Denise L. Ferensic
*Assistant Examiner*—Joanne Y. Kim
*Attorney, Agent, or Firm*—Renner, Otto, Boisselle & Sklar, P.L.L.

[57] ABSTRACT

A venting device intended for connection to a horizontal sanitary vent pipe, in which vacuum pressure excursions occur providing a need for the introduction of air from the outside of the pipe automatically by way of the device without allowing a reverse flow of the evil air from inside the pipe when pressure within is equalized or risen. The device has three adjacent ends. A first end comprises a cap forming tubular chamber integrally housing therein a suitable valve sealing means substantially covering an air inlet means situated within the chamber. The sealing means is securely closed at equilibrium and against high pressure, whilst automatically opening a vacuum within the pipe to admit air. The first end is adjacent a lower tubular body portion having a second and third end. The second end forms a suitable means for affixing the device to a horizontal vent pipe; whereas the third end terminates to an opening which may normally be closed by way of a removable repeatable access fitting. The device may be fully encased within a suitable wall mounted receptacle having a removable face with a plurality of air openings providing air movement, concealability and ready accessibility within a wall cavity to the venting device.

19 Claims, 5 Drawing Sheets

VACUUM BREAKER VALVE VENT FITTING CLEAN-OUT DEVICE

CROSS-REFERENCE TO RELATED APPLICATIONS

This application is a continuation of U.S. patent application Ser. No. 08/706,669, filed Sep. 4, 1996.

FIELD OF THE INVENTION

The invention is in the field of air valves for plumbing sanitary drainage systems that eliminate plumbing vent pipes from extending upwardly through the building structure and roofing membrane to the outside air.

BACKGROUND OF THE INVENTION

Sanitary drainage systems for buildings incorporate a network of pipes for conveying waste materials out of the building. At each point of conveyance U.S. building codes require a certain water trap containing a minimum requirement of a two inch column of water which thereby prevents the passage of foul contaminated air into buildings via the sanitary piping system. The primary reason that water seals in fixture traps connected to the sanitary pipe must be protected is that spent water discharged into the drainage system causes interaction with air at the air water interface inside the pipe. A portion of the energy from the moving water is transferred to air setting it into motion. This flow of air at the core of the pipe in vertical drainage piping and at the top of the pipe in horizontal branch piping generates a negative pressure excursion as it moves through the sanitary system. If the negative pressure exceeds the allowable limit defined by codes, water trap seal loss by siphonage will occur at an unacceptable level.

Air admittance valve devices are known (U.S. Pat. Nos. 2,461,392, 3,923,081, 4,232,706, 4,545,398, 4,867,802, 5,048,562, 5,273,068 and others) for the purpose of allowing air to enter sanitary pipe work within buildings whilst preventing the passage of contaminated air outwardly from the piping system via the device during conditions of normal use. The specifications above rely on a body formed by a vertical tube in communication with a sanitary vent pipe and atmosphere having two ends; a lower end being tubular having means for engaging a pipe, and on the axially opposite end a tubular chamber, integrally housed therein, a suitable valve sealing means substantially covering an air inlet means situated within the chamber. The sealing means is securely closed at equilibrium and against high pressure whilst automatically opening upon a vacuum within the pipe to admit air, thus causing automatic equalization of the vacuum pressure to occur preventing trap water seal loss by siphonage.

There are field installation problems associated with known venting devices that consume labor and material. As shown in FIG. 7, a vent pipe 10 has a beginning at or within close proximity of fixture trap 13 requiring ventilation. The point of beginning for a vent pipe is the same, independent of whether or not a known venting device 20 is used. Vent termination point 80, however, is thereby redirected when the venting device 20 is installed in lieu of an actual vent pipe 10 through the roof 85. The redirected termination point is the venting device 20 and is commonly located within close proximity of the fixture trap 13. Piping materials and labor are thereby reduced when compared with an actual vent pipe 10 extending through the building structure and roofing membrane 85, to the outside air. Vent pipe 10 has been eliminated through use of a known venting device 20 affixing to a redirected vent pipe having a beginning at sanitary tee fitting 11 rising vertically above waste connection 19 via pipe 15 to 90° fitting 16 thus offsetting horizontally within a wall cavity. The 90° fitting 16 affixes to vent pipe 17 which continues a necessary distance so as to avoid interference between the venting device 20 and water supply tubes, sink bottom, drain pop up assembly and the like. A 90° fitting 18 affixes to the vent pipe 17 within a horizontal plane and further to pipe stub 21 protruding outwardly from the wall cavity. Altogether parts 16, 17, 18 and 21 comprise the redirected vent pipe. Stub out 19 forms a continuation of vertical drainage pipe 14 via the tee fitting 11, to which the fixture trap 13 is eventually installed.

As further shown in FIG. 7, the piping that comprises a drainage and vent system is required to be tested, after which the known venting device 20 is affixed to the pipe stub 21, by way of a code approved, pipe compatible joining means in which a 90° pipe fitting 23 is affixed to the pipe stub 21 orienting said venting device 20 vertically. Where removability of the venting device 20 is required adapter fitting 22 is utilized in conjunction with and contiguous to the 90° pipe fitting 23.

1. It is code required that known venting devices shall be removable for service or replacement. Pipe adapter fitting 22 provides removability thereof when the venting device 20 is affixed to a horizontal vent pipe stub via 90° fitting 23.
2. Known venting devices within the field of invention are dependent upon vertical orientation for operation. Thus a code requirement that the venting device 20 shall be affixed to the vent pipe in a vertically plumb orientation exists. When the venting device 20 is affixed to horizontal pipe stub 21, additional pipe fittings are required to maintain vertical orientation of the venting device 20. To affix a vertically oriented known venting device 20 to horizontal vent pipe 17, a 90° fitting 18 or pipe stub 21 and additional pipe fittings 22 and 23 are required since many connection means disclosed in prior art for adjoining such known venting devices to a pipe do not meet applicable standards referenced with the codes.
3. Where a vertical drainage pipe 14 turns horizontally at base 25 and continues, it is further code required to situate access fitting 24 proximate the base 25 for enabling accessibility to the piping system in the event of a blockage or stoppage of drainage flow. Some code jurisdictions waive requirement for actual access fitting 24 In light of the fact that the vent pipe 10 through roof 85 constitutes one such point of access to the drainage system for serviceability in the event of a drain blockage or stoppage. When the vent pipe 10 through the roof 85 is eliminated by use of the venting device 20, an actual clean-out access fitting 24 must then be installed at or near base 25 of the vertical drainage pipe 14.
4. As shown in FIG. 8, because of the vertical space L occupied by radius R of 90° fitting 18 and adapter fitting 22, it often becomes impractical to position a horizontally redirected vent pipe 17, via the 90° fitting 18 and adapter fitting 22 adjacent the known venting device 20 housed within a receptacle, together, concealed within a wall cavity.

SUMMARY OF THE INVENTION

The improved automatic venting device of the present invention is capable of:

1. as shown in FIGS. 1 and 2, providing tamper and vandal resistant operational valve means within a removable first end 10, adjacent second 41 and third end opening 45 thereby meeting applicable valve service and or replacement demands required by code;
2. eliminating installation of additional pipe fittings 22 and 23 (FIG. 7) required to affix known venting device 20 to horizontal vent pipe 17 via 90° fitting 18 or pipe stub 21 by way of second end 41 adjacent removable first end 10 and third end opening 45 (FIGS. 1 and 2);
3. eliminating access fitting 24 (FIG. 7) by providing a reusable clean-out plug 50 (FIGS. 1 and 2) affixed to third end opening 45 for future piping system maintenance or service in the event of a drain blockage, in which the third end opening 45, is adjacent the first end 10 and second end 41;
4. as shown in FIGS. 5 and 6, providing a suitable receptacle 3 with a removable cover 2, having a plurality of air openings to house the venting device 60 encased within a wall cavity, the venting device 60 connecting to horizontal vent pipe 17.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF PREFERRED EMBODIMENTS

Figure 1:
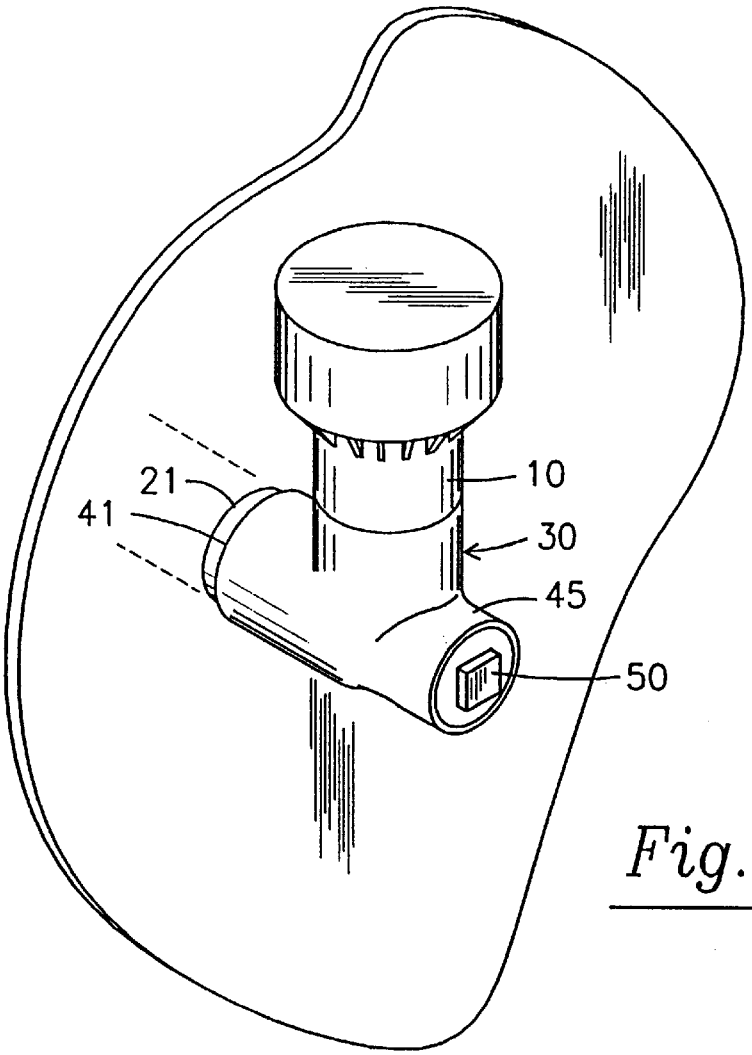
FIG. 1 represents an elevational view of a first device in accordance with the invention.
Figure 2:
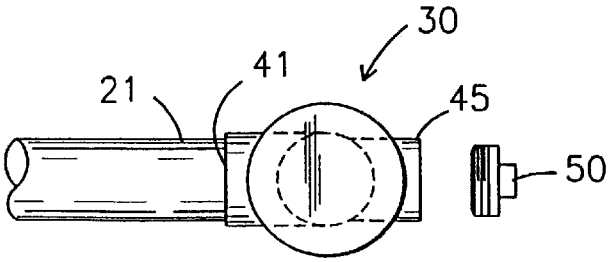
FIG. 2 represents a plan view of a first device in accordance with the invention.
Figure 7:
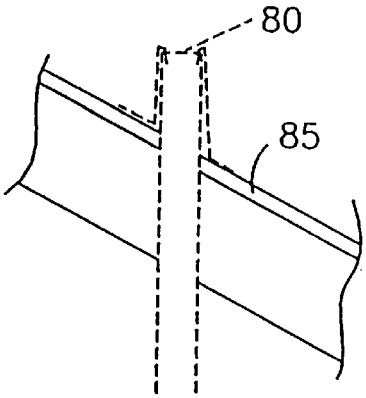
Fig. 7 PRIOR ART
FIG. 7 represents an isometric view of a conventional drain and vent pipe installation within a wall cavity, where a known device is installed outside a wall cavity.

Referring now in detail to the drawings in which like characters designate corresponding parts throughout the several views, FIG. 1 shows an improved venting device 30 having three ends: first end 10; second end 41; and third end 45. Referring also to FIG. 4, the first end 10 comprises a cap 7 forming tubular chamber integrally housed therein, a suitable valve sealing means 9 substantially covering air inlet means 8 situated within the chamber. The sealing means 9 is securely closed at equilibrium and against high pressure, whilst automatically opening upon a vacuum within the pipe to admit air, thus equalizing internal pressure in sanitary drainage piping for protecting a water seal in trap 13 (FIG. 7) against siphonage. Adjacent lower body 40 provides for valve replacement or service. The lower body 40 comprises two adjacent ends, of which second end 41 affixes the device 30 to horizontal vent pipe 17 (FIG. 2) or a 90° fitting 18 (FIG. 3), adjacent third end opening 45, having means for resealing 50.

Figure 3:
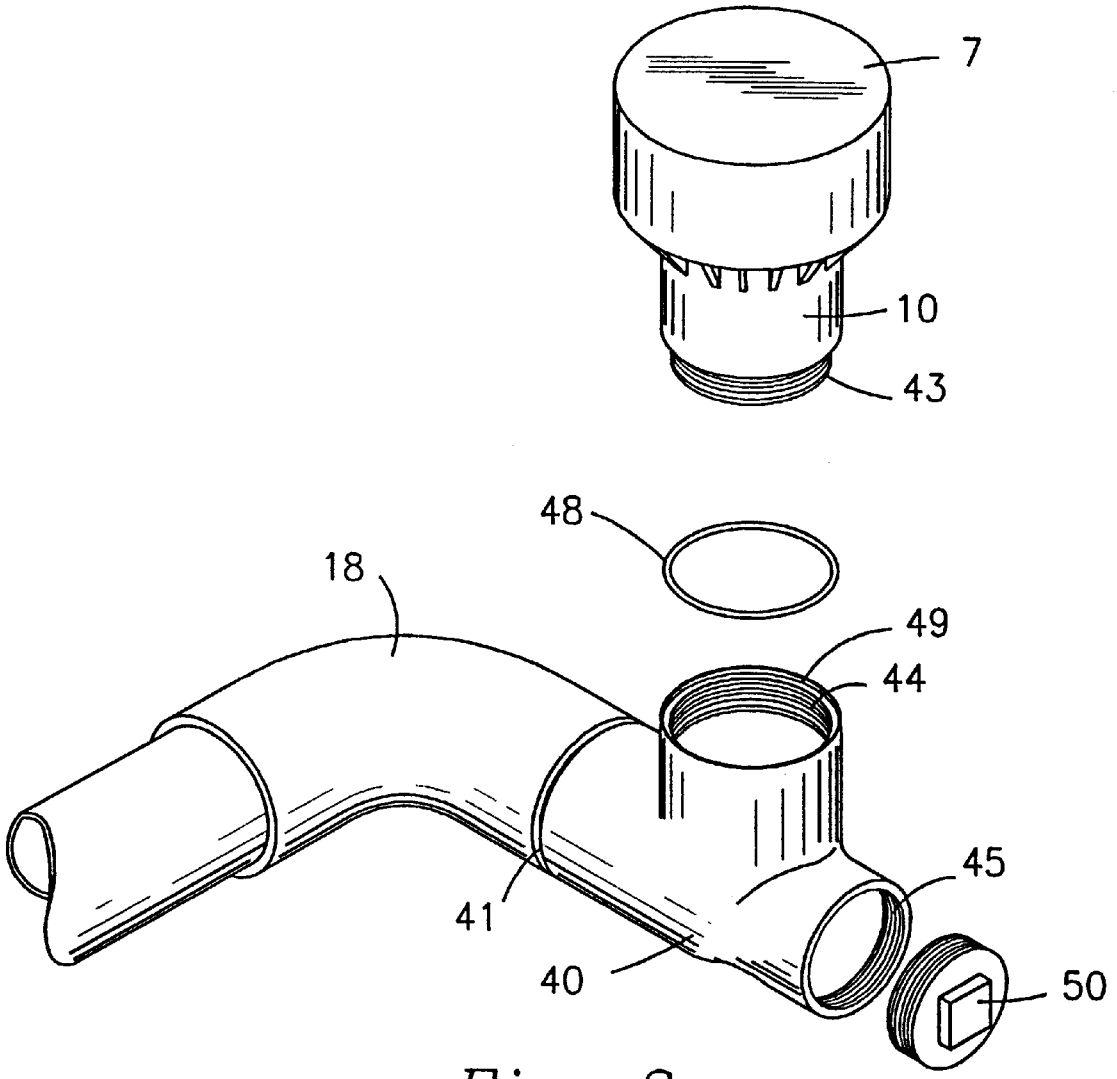
FIG. 3 represents an exploded elevation view of a first device connected to a horizontal vent pipe via a 90° pipe fitting in accordance with the invention.
Figure 4:
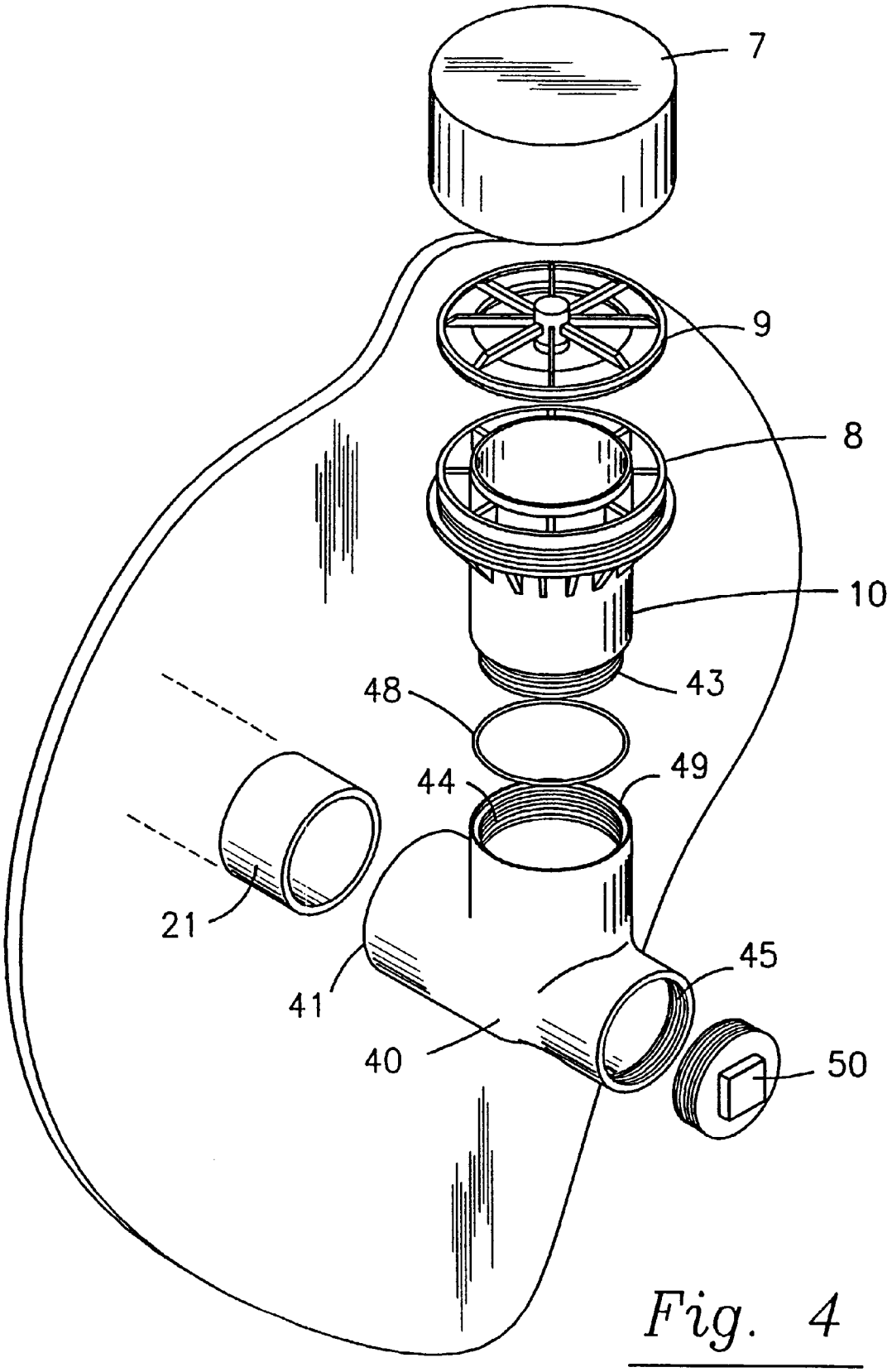
FIG. 4 represents an exploded elevational view of a first device connected to a horizontal vent pipe protruding from a wall cavity in accordance with the invention.

As shown in FIG. 3, first end 10 may be readily removed for valve replacement or service from lower body 40 without adverse effect to the permanent pipe connection between the 90° fitting 18 and second end 41. An airtight, inconspicuous, tamper and vandal resistant means providing removal of the first end 10 may include left hand threads 43 and 44, in combination with o-ring 48 and groove 49.

Figure 5:
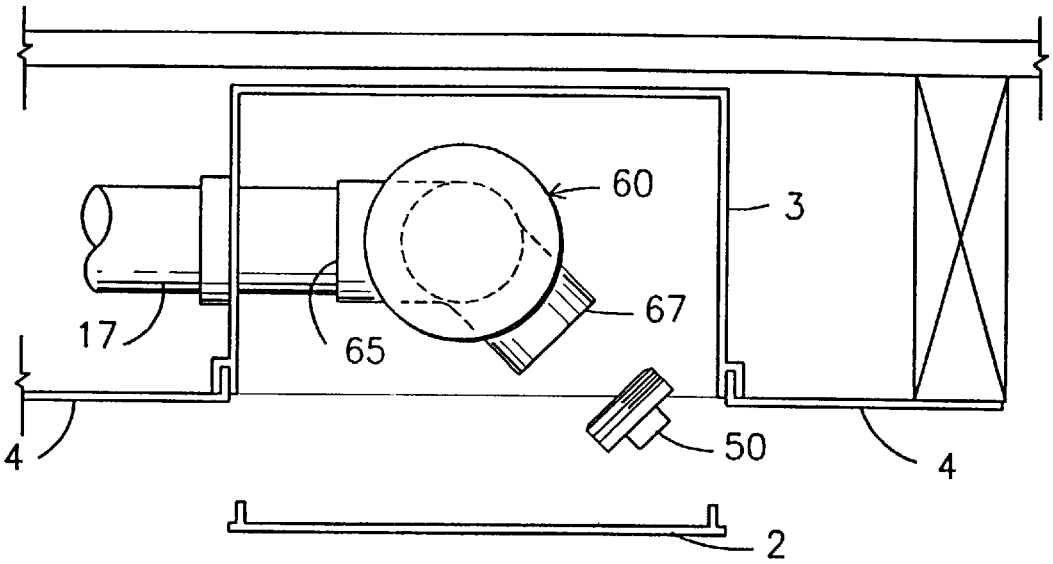
FIG. 5 represents a plan view of a second device connected to a horizontal vent pipe encased within a wall mounted receptacle in accordance with the invention.
Figure 6:
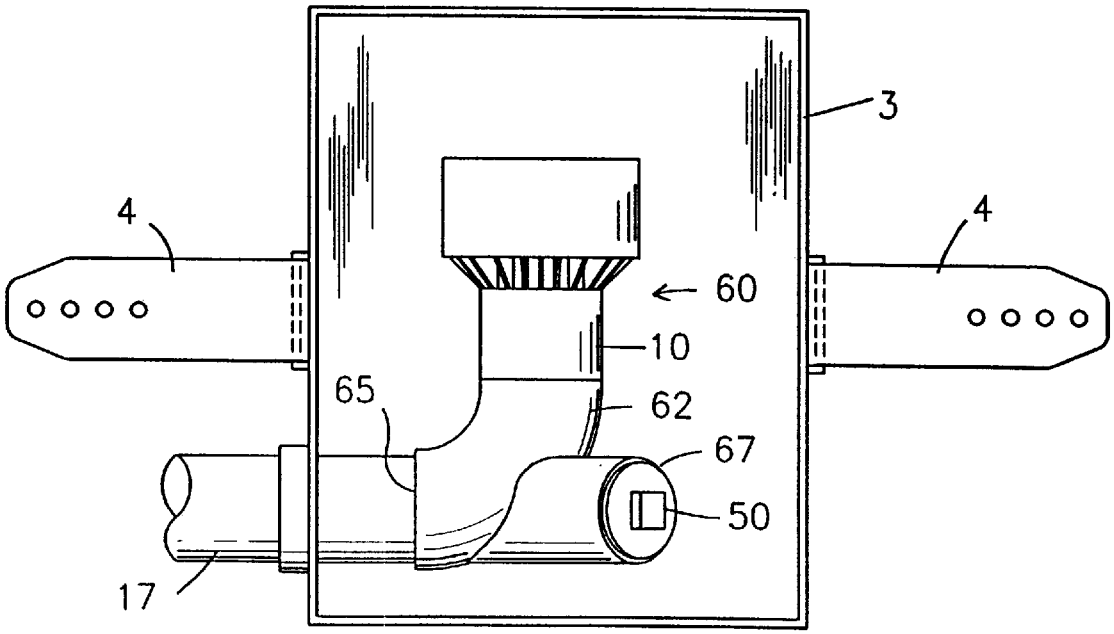
FIG. 6 represents a side elevational view of a second device connected to a horizontal vent pipe encased within a wall mounted receptacle in accordance with the invention.

FIGS. 5 and 6 show another improved venting device 60 in accordance with this invention having three ends; a first end 10, a second end 65, and a third end opening 67. The first end 10 comprises a cap 7 (FIG. 4) forming a tubular chamber, integrally housed therein a suitable valve sealing means 9, substantially covering an air inlet means 8 situated within the chamber. The sealing means 9 is securely closed at equilibrium and against high pressure, whilst automatically opening upon a vacuum within the pipe to admit air, thus equalizing internal pressure in sanitary drainage piping for protecting a water seal in trap 13 (FIG. 7) against siphonage. As shown in FIG. 6, the adjacent lower body 62, comprising two other ends of which second end 65 affixes said venting device 60 (FIG. 5), to horizontal vent pipe 17 obliquely adjacent said third end opening 67 having means for sealing 50.

As shown in FIG. 6, the first end 10 of venting device 60 may be readily removed for valve replacement or service from lower body 62 without adverse effect to the permanent pipe connection between vent pipe 17 and the second end 65. Referring now to FIG. 3 an airtight, inconspicuous, tamper and vandal resistant means providing removal of the first end 10 may include left hand threads 43 and 44, in combination with o-ring 48 and groove 49.

A further object is to eliminate actual clean-out access fitting 24 (FIG. 7) at the base of vertical drainage pipe 14 by providing third end opening 45, adjacent second end 41. Covering third end opening 45 is removable plug 50, so that under conditions of normal use the third end opening 45 remains securely closed. When a drain blockage occurs plug 50 is readily removed from end opening 45 providing a repeatable end opening combination, thus permitting drain clearing apparatus or device to enter the piping system for clearing the blockage, when the improved device 30 is installed to horizontal vent piping, as represented in FIG. 1.

Figure 8:
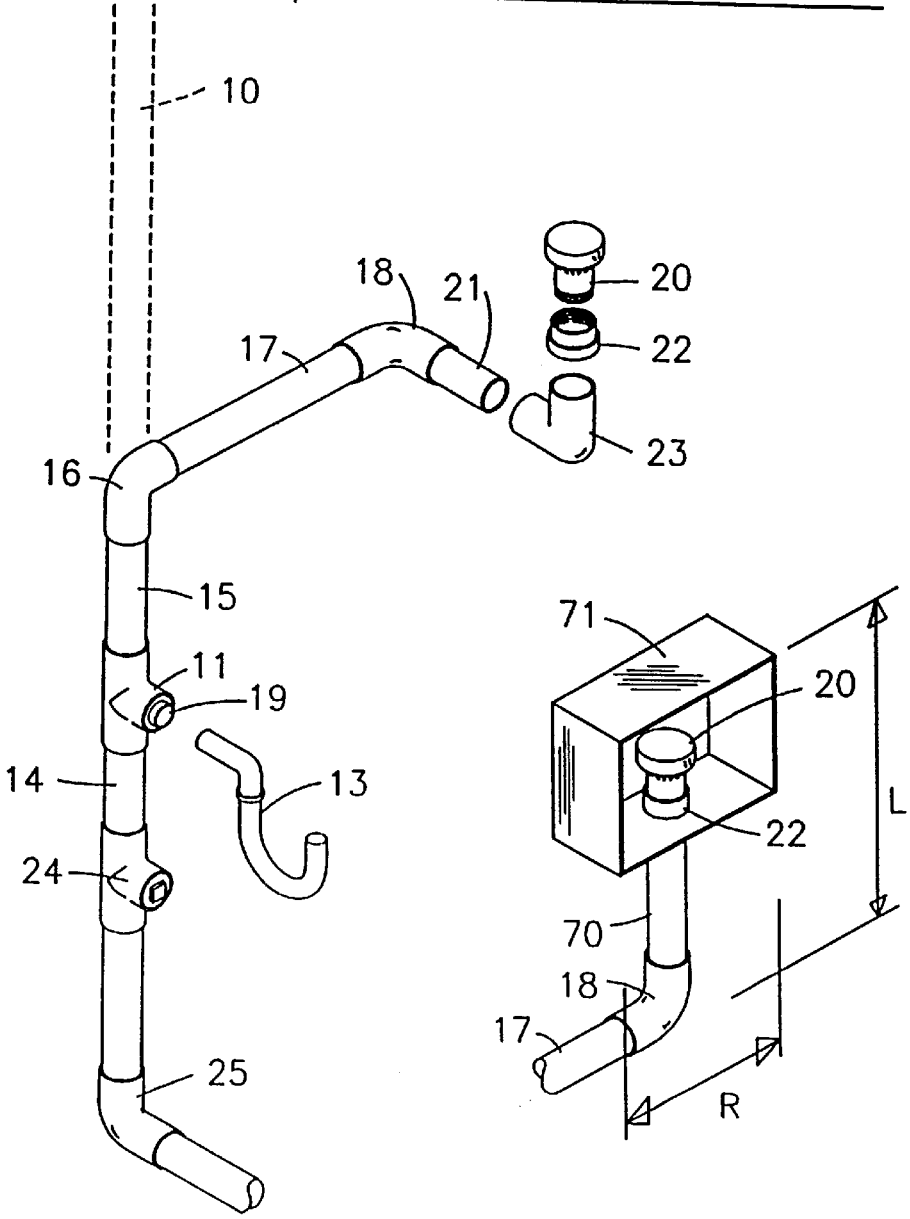
Fig. 8 PRIOR ART
FIG. 8 represents an isometric view of a conventional drain and vent pipe installation within a wall cavity, where a known device is housed within a receptacle and installed inside said wall cavity.

A further object of the venting device 60 (FIGS. 5 and 6) is to decrease the amount of space squandered by way of length L of adapter fitting 22 and radius R of 90° fitting 18, when the known venting device 20 is installed within wall cavity 71, as shown in FIG. 8. This is accomplished by providing the venting device 60 (FIGS. 5 and 6) with three ends as previously described. The first end 10 provides removability for maintenance or service, and is capable of resisting or equalizing internal pressure in sanitary drainage piping for protecting water seal in a trap 13 (FIG. 7) against siphonage. The second end 65 (FIG. 6) affixes the venting device 60 to horizontal vent pipe 17, and the third end opening 67 has repeatable means 50. The device 60 may be encased and housed in a suitable receptacle 3, having a suitable removable face 2 providing access and removability. Air movement is allowed via a plurality of openings formed in face 2. Device 60 eliminates 90° fitting 18 (FIG. 8), pipe 70 and adapter fitting 22 over a known venting device 20 affixed to a horizontally redirected vent pipe 17.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. An air admittance valve adapted to be affixed to a vent pipe of a sanitary drainage system of a building to eliminate the need for said vent pipe to extend through the roof of the building comprising a tubular body member having a total of three ends, a first of said ends being adapted to be affixed to said sanitary drainage vent pipe, a second of said ends comprising an upper end, valve means directly connected to said second end for admitting ambient air to said vent pipe through said second end and said first end upon the presence of a pressure drop in said vent pipe and for closing off said second end at equilibrium and when there is an increase of pressure in said body member thus preventing the escape of fluid through said second end, and a third of said ends opening to the exterior of said body member and communicating with said first and second ends interiorly of said body member.

2. The air admittance valve of claim 1 wherein said valve means and said second end of said body member are threaded for threadedly connecting said valve means directly to said second end of said body member.

3. The air admittance valve of claim 2 wherein said valve means and said second end of said body member have left hand threads to make said valve means tamper and vandal resistant.

4. The air admittance valve of claim 1 wherein said third end is threaded.

5. A vacuum breaker valve vent fitting clean-out device for connection to a horizontal vent pipe of a sanitary drainage system of a building, said device comprising a plastic body portion having two opposite end ports in substantially direct alignment with each other and a side port intermediate said end ports, the axis of said side port being substantially perpendicular to the axes of said end ports, one of said end ports being connectable to said horizontal vent pipe, and an other of said end ports terminating in a threaded opening closed by a removable threaded plug which when removed permits access to said system through said end ports and said vent pipe for cleaning out said system, and valve means for admitting ambient air to said vent pipe through said side port and said one end port upon the presence of a vacuum in said body portion while preventing the escape of fluid from said system through said side port, said valve means and said side port being threaded for threadedly connecting said valve means directly to said side port.

6. The device of claim 5 wherein said valve means comprises a tubular valve body extending coaxially outwardly from said side port, and a valve member for closing off said valve body at equilibrium and when there is an increase of pressure in said body portion thus preventing the escape of fluid from said system through said side port, said valve member allowing for passage of ambient air through said valve body when a vacuum is present in said body portion.

7. The device of claim 6 wherein said valve means comprises inner and outer valve seats at an outer end of said valve body, a cap mounted on said outer end of said valve body encompassing said valve seats and forming a valve chamber, and a valve member movable within said valve chamber, said valve member being maintained in sealing engagement with said valve seats at equilibrium and during an increase in pressure within said vent pipe and said valve chamber, thus preventing the escape of fluid from said system through said side port.

8. The device of claim 7 wherein said cap is removably connected to said valve body for service and replacement of said valve member.

9. The device of claim 5 wherein said side port and said valve means have left hand threads to make said valve means tamper and vandal resistant.

10. An air admittance valve adapted to be affixed to a sanitary drainage vent pipe comprising a tubular body member having total of three ends, a first of said ends being adapted to be affixed to said sanitary drainage vent pipe, a second of said ends comprising an upper end having valve means allowing for passage of ambient air to said vent pipe through said first end upon the presence of a pressure drop in said vent pipe and for closing off said second end at equilibrium and when there is an increase of pressure in said body member thus preventing the escape of fluid through said second end, and a third of said ends communicating with said first and second ends interiorly of said body member, and a removable plug within said third end of said body member, and a receptacle having a back wall, top and bottom walls, side walls and an open face enclosed by a removable cover, at least one of said side walls having an opening through which a horizontal end portion of said vent pipe extends into said receptacle, said first end of said body member being in coaxial alignment with said horizontal end portion and connected to said horizontal end portion within said receptacle, and said third end of said body member being accessible through said open face of said receptacle when said cover is removed to permit removal of said plug for accessing said vent pipe through said body member for cleaning out said vent pipe, the axis of said first end of said body member extending substantially horizontally within said receptacle in a direction substantially perpendicular to said one side wall of said receptacle, the axis of said third end of said body member extending substantially horizontally within said receptacle and at an angle relative to said first end in a direction toward said open face of said receptacle, and the axis of said second end of said body member extending substantially vertically within said receptacle.

11. A vacuum breaker valve vent fitting clean-out device for a sanitary drainage system of a building having at least one horizontal vent pipe, said device comprising a plastic body portion having two opposite end ports in substantially direct alignment with each other and a side port intermediate said end ports, the axis of said side port being substantially perpendicular to the axes of said end ports, one of said end ports being connected to a horizontal end portion of said vent pipe, and an other of said end ports terminating in a threaded opening closed by a removeable threaded plug which when removed permits access to said system through said end ports and said vent pipe for cleaning out said system, said side port being threaded for threaded receipt of valve means for admitting ambient air to said vent pipe through said side port and said one end port upon the presence of a vacuum in said body portion while preventing the escape of fluid from said system through said side port, and a receptacle having a back wall, top and bottom walls, side walls and an open face enclosed by a removable cover, at least one of said side walls having an opening through which a horizontal end portion of said vent pipe extends into said receptacle, said one end port of said device being in coaxial alignment with said horizontal end portion and connected to said horizontal end portion within said receptacle, said other end port of said device being accessible through said open face of said receptacle when said cover is removed to permit removal of said plug for accessing said system through said end ports and said vent pipe for cleaning out said system, the axis of said one end port extending substantially horizontally within said receptacle in direction substantially perpendicular to said one side wall of said receptacle, the axis of said other end port extending substantially horizontally within said receptacle and at an angle relative to said first end port in a direction toward said open face of said receptacle, and the axis of said side port extending substantially vertically within said receptacle.

12. An air admittance valve adapted to be affixed to a vent pipe of a sanitary drainage system of a building to eliminate the need for said vent pipe to extend through the roof of the building comprising a tubular body member having a total of three ends, a first of said ends being adapted to be affixed to said sanitary drainage vent pipe, a second of said ends comprising an upper end having valve means for admitting ambient air to said vent pipe through said second end and said first end upon the presence of a pressure drop in said vent pipe and for closing off said second end at equilibrium and when there is and increase of pressure in said body member thus preventing the escape of fluid through said second end; and a third of said ends communicating with said first and second ends interiorly of said body member, and a removable plug within said third end of said body member.

13. The air admittance valve of claim 12 in combination with a receptacle having a back wall, top and bottom walls, side walls and an open face enclosed by a removable cover, at least one of said side walls having an opening through which a horizontal end portion of said vent pipe extends into said receptacle, said first end of said body member being in coaxial alignment with said horizontal end portion and connected to said horizontal end portion within said receptacle, and said third end of said body member being accessible through said open face of said receptacle when said cover is removed to permit removal of said plug for accessing said vent pipe through said body member for cleaning out said vent pipe.

14. The combination of claim 13 wherein the axes of said first and third ends of said body member extend substantially horizontally within said receptacle, and the axis of said second end extends substantially vertically within said receptacle.

15. A vacuum breaker valve vent fitting clean-out device for connection to a horizontal vent pipe of a sanitary drainage system of a building, said device comprising a plastic body portion having two opposite end ports in substantially direct alignment with each other and a side port intermediate said end ports, the axis of said side port being substantially perpendicular to the axes of said end ports, one of said end ports being connectable to said horizontal vent pipe, and an other of said end ports terminating in a threaded opening closed by a removable threaded plug which when removed permits access to said system through said end ports and said vent pipe for cleaning out said system, valve means threadedly connected to said side port for admitting ambient air to said vent pipe through said side port and said one end port upon the presence of a vacuum in said body portion while preventing the escape of fluid from said system through said side port, and a receptacle having a back wall, top and bottom walls, side walls and an open face enclosed by a removable cover, at least one of said side walls having an opening through which a horizontal end portion of said vent pipe extends into said receptacle, said one end port of said device being in coaxial alignment with said horizontal end portion and connected to said horizontal end portion within said receptacle, said other end port of said device being accessible through said open face of said receptacle when said cover is removed to permit removal of said plug for accessing said system through said end ports and said vent pipe for cleaning out said system.

16. The device of claim 15 wherein the axes of said end ports extend substantially horizontally within said receptacle, and the axis of said side port extends substantially vertically with said receptacle.

17. The device of claim 15 wherein said opening in said side wall of said receptacle is rimmed with a collar projecting horizontally outwardly from said receptacle for supporting said horizontal end portion of said vent pipe in said opening, said valve means being accessible through said open face of said receptacle when said cover is removed to permit removal of said valve means for service and replacement.

18. The device of claim 15 wherein said receptacle is mounted in a recess in an accessible wall portion of said building, said wall portion containing an opening in line with said open face of said receptacle, said cover completely covering said opening and said open face of said receptacle.

19. The device of claim 18 further comprising flanges protruding outwardly from opposite sides of said receptacle for attaching said receptacle between a pair of adjacent studs in said wall portion.

* * * * *